United States Patent [19]

Baldwin

[11] Patent Number: 4,867,315

[45] Date of Patent: Sep. 19, 1989

[54] VIAL FILLING, HOLDING AND SERVING TRAY ARRANGEMENT AND METHOD

[76] Inventor: Brian E. Baldwin, 8022 S. Niagara Way, Englewood, Colo. 80112

[21] Appl. No.: 202,316

[22] Filed: Jun. 6, 1988

[51] Int. Cl.[4] ..... B65D 83/04

[52] U.S. Cl. ..... 206/558; 206/820; 53/471; 53/489

[58] Field of Search ..... 206/558, 561, 820; 53/471, 473, 489, 319, 330

[56] References Cited

U.S. PATENT DOCUMENTS

| | | | |
|---|---|---|---|
| 3,587,910 | 6/1971 | McCarthy | 206/427 X |
| 3,660,960 | 5/1972 | Inman | 53/471 X |
| 4,122,651 | 10/1978 | Braverman | 53/471 X |
| 4,693,371 | 9/1987 | Malpass | 206/561 X |
| 4,735,318 | 4/1988 | Keffeler | 206/561 X |

*Primary Examiner*—Allen M. Ostrager
*Attorney, Agent, or Firm*—Reginald F. Pippin, Jr.

[57] ABSTRACT

An invertable tray/vial package assembly is disclosed formed of separable interlockably connected top and bottom vial holding and locating tray sections which tray enables and effects holding and spatial positioning of a plurality of vials therein for selective external access to the vials at their respective opposite fluid content filling ends and fluid serving ends, for ease of vial filling, closing, handling, labeling and visual identification of vial contents, and for dispensing of the vials and serving the fill content of a vial to a patient. The tray has vial holding and spatially positioning pockets formed on one of its separable sections, with fluid-fill enabling openings formed in the bottom end of each of the pockets, and which are effectively registrable with closeable fill openings of vials disposed therein. The serving mouth ends of the vials are sealed with a peelably removable sealing strip which joins a column of vials together with tear perforations therebetween, and onto which sealing strip is secured a correspondingly tear-perforated labeling strip after filling of the vials and closure of the fill end, of the vials filling and labeling of the vials without necessity for removal of the vials from the tray to effect such filling and labeling.

29 Claims, 5 Drawing Sheets

VIAL FILLING, HOLDING AND SERVING TRAY ARRANGEMENT AND METHOD

DESCRIPTION OF THE INVENTION

This invention relates to the filling and handling of vials in a hospital or other health care use facility, and more particularly to a vial filling, holding, and serving tray arrangement and method which enables ease of vial filling, handling, and transporting, as well as ease of labeling and subsequent identifying and serving of filled vials in a hospital or other health care facility, and which is particularly useful in the repackaging of oral liquid drug products by hospitals and other health care facilities.

Repackaging of oral liquid drug products by hospitals has been practiced for the past 15 years. The first product was a glass vial with crimped-on aluminum cap seals requiring a mechanical tool for crimping. Several plastic vials have been made available which enable the pharmacy to fill through a hole or slit in the cap or bottom of the vial. The holes are sealed by pressing in a plug of various shapes.

Until now, the vials have been packaged in trays with plastic film sealing over the complete tray of from 25 to 100 vials. The trays need to be unwrapped by the pharmacy. The vials are then filled. They then need to be capped or plugged, using a tool or, in some cases, the plugs are pressed in by hand. The vials then need to be labelled. This requires removing from the tray arrangements either by turning the tray over completely to remove the vials or picking them up individually to place the label.

The labor costs in unwrapping such trays, and the numerous handling steps in the prior art procedures, have produced a need for an improved packaging system and method which allows filling all of the vials in a covered tray without unwrapping, or removal of the vials from the tray. Such improved system and method should also enable and encompass the sealing closure of the vials' fill openings and the placement of labels on the vials without removal of the vials from the tray.

It is an object and feature of the invention to provide a tray/vial packaging arrangement and method which enables a hospital or other health care facility to easily fill all of the vials in a covered tray without need for unwrapping of the vials, or of the tray (unless such may be deemed desirable in a given instance of use), and without removal of the vials from the tray, and which also enables ready closing of the fill openings, as with sealing plugs handling of the tray/vial assembly as a unit with the vials contained therein, prior to, during and after filling, and up to the point of subsequent desired serving or dispensing of a filled vial to a patient.

It is a further feature of the invention to provide an improved vial filling and holding arrangement and method which enables filling, sealing plug placement, and labeling of the vials without need for manual handling of the vials, and without need for removal of the vials from the tray in order to carry out the filling and labeling of the vials.

Still another object and feature is the provision of a vial packaging system and method in which a tray carries a plurality of vials with means for selective external access to the vials at their opposite ends for respective filling, sealing plug placement, and labeling of the vials without necessity for removal of the vials from the tray to effect such filling, sealing plug placement, and labeling.

A still further feature of the invention is the provision of an improved tray/vial package arrangement which enables easier and less expensive filling, sealing plug placement, labeling and other handling than prior art tray/vial arrangements.

Still other objects, features and attendant advantages will become apparent from a reading of the following detailed description of an illustrative and preferred embodiment of the invention, taken in conjunction with the accompanying drawings, wherein:

FIG. 9 is a schematic side view in partial section illustrating the heat sealing assembly of a column of vials with a perforated interconnecting strip of foil or the like.

Figure 1:
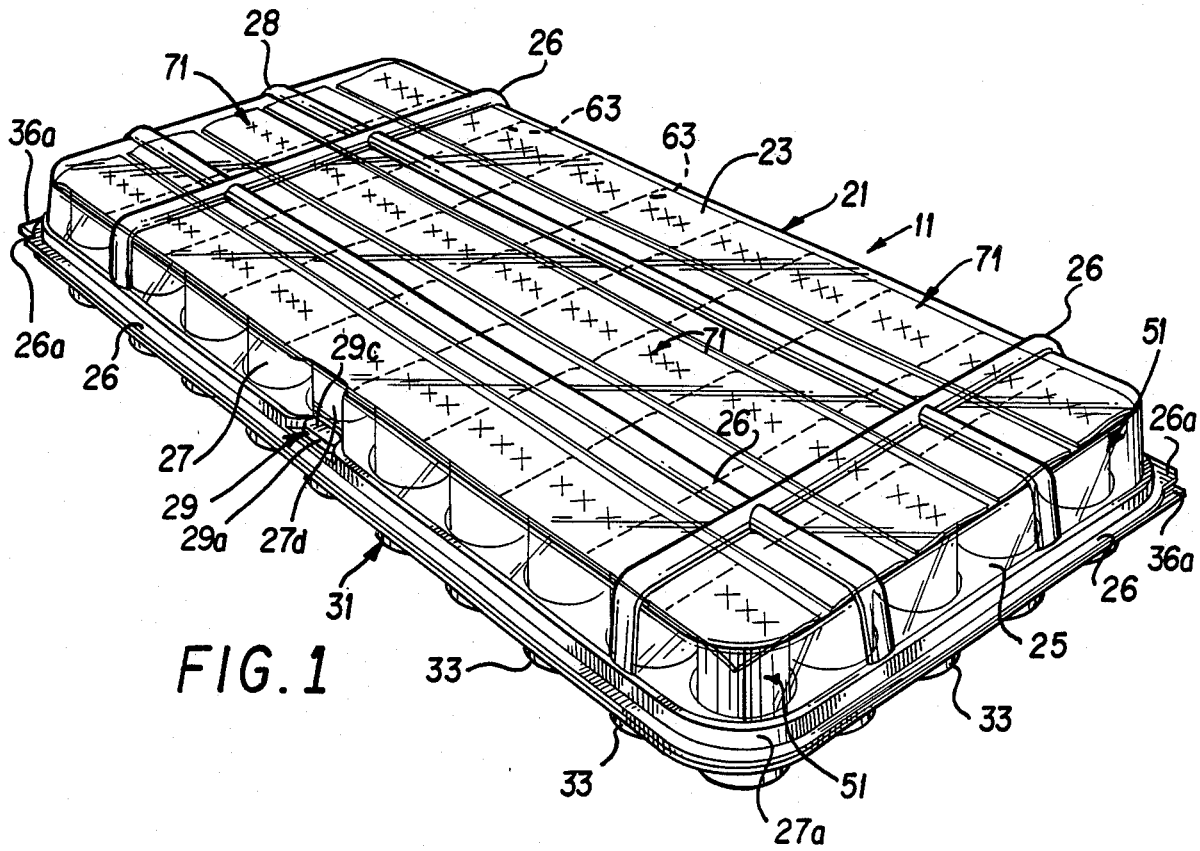
FIG. 1 is an isometric view of a tray and vial package embodiment according to the invention.

Referring now in detail to the figures of the drawing, a tray 11 is provided in the form of a bottom vial-holding and -positioning section 31 and an interfacing and removably interlockably connected vial-holding top tray section 21. The bottom tray section 31 has a plurality of rows of pockets 33, each of which serves to hold and effectively laterally position a respective vial 51 of several columns 71 of vials 51, the illustrative embodiment employing 5 columnar assemblies 71 of interconnected vials 51, each of which columns is formed of ten vials 51 in the illustrative embodiment, interconnected by a sealing strip 61 suitably secured to and over flanged open dispensing mouth ends of the vials 51, as by heat sealing of a suitable manually peelably removable fluid sealing strip 61 of sheet material, such as foil, to flat annular flanges 57 formed at and about the dispensing mouth end of the vials 51. The foil sealing strips 61 are preferably tear perforated, as indicated at 63, across their width at equal spaced locations between each of the vials 51 in each columnar assembly 71.

Each of the vials 51 forms a small fluid fillable easily hand-holdable vessel having a dispensing mouth end formed by a tear separable section of foil strip 61, which is manually peelably removably heat sealed across the face of peripheral end flange 57 formed on the dispensing mouth end of a cup shaped body having a slightly tapered annular side wall 53, with a bottom end wall 55 which is preferably sloped inward and which has a sealable fill opening 55*a* formed therein as by an annular sleeve wall 58 which extends longitudinally inwardly within peripheral side wall 53 toward the foil sealed mouth end of the vial.

The flanged tapered oppositely open ended cup-shaped body of each vial 51 may be suitably formed of thermoplastic material as by thermoplastic injection molding.

Sleeve wall 58 has an inner concavely curved annular ball plug-retaining surface 56 extending between its annular open fluid-filling inlet end 56*a* and its annular inner facing open end 56*b*. A plastic ball plug BP (see FIG. 10) having a diameter slightly exceeding the largest inner diameter portion of concave sleeve wall surface 56 may be push inserted in sealing and mechanically securely retained position within the fill mouth opening formed and bounded by wall surfaces 56*a*, 56, 56*b*, to effectively seal the fill opening 55*a*. Such push insertion of the ball plug BP may be effected either manually, or with tool assistance, or by machine, as may be desired.

Label or identifier strips 81 are provided, for attachment to the foil strip 61 of each columnar assembly after filling of the vials is accomplished, as later described. To this end, the label strips may be and are preferably suitably formed of strips of paper or other suitable labeling sheet material which is tear perforated across its width as indicated at 83 at intervals such as to correspond in lengthwise location to the location of Perforated lines 63 on the foil strips 61 interconnecting each column of vials 51. One face of label strips 81 has a character suitable for forming or attaching visual indicia thereon, such as by typing, printing or writing of letters, numbers , etc either manually or by machine, such as by a computer controlled printer which preprints tear-perforated labels 81 independently in groups for various potential fluid fillings, or prints such as a function of input data on a given fill operation, to reflect the fill contents of the various vials 51 after filling, to indentify and enable ready visual identification of the contents of each of the vials secured to each respective tear-separable portion of foil sealing strip 61, such indicia being generally indicated at 87 by simple XXX markings representing any desired marking for each individual vial.

The opposite adhesive securing face 89 of each of the tear-perforated label strips 81 has securing surface, preferably formed by a suitable pressure sensitive adhesive surface coating formed in any conventional or desired manner, which enables the perforated label strip 81 to be secured directly into the outer face of a correspondingly tear-perforated foil sealing strip 61 for each of the vial columnar assemblies 71 after completion of filling of the vials, 51, with the perforations of strips 61 and 81 in effectively substantially longitudinally spatial registry, which permits ease of subsequent tear separation of the vials 51 from one another after filling and at any given desired use location.

Referring to FIGS. 1, 2, 6 and 7, the tray sections 21 and 31 are separably secured together along respective interfacing rims 26 and 36. To this end, the rim 26 of tray section 21 has a negative sloped peripheral wall 27*a* which is complementarily interlockably engagable with a correspondingly negative sloped peripheral wall 37*a* formed in peripheral rim 36 of tray section 31. The negative slope may suitably be of the order of approximately 5–10 degrees, a slope of 6 degrees being utilized in one illustrative embodiment. The negative sloped walls 27*a* and 37*a* adjoin interfacing and abutting peripheral recess walls 27*b*, 37*b* formed in the rims 26 and 27, which together with the flat planar outer perpheral end walls of rims 26 and 27 enable seated mating securement of the rims 26 and 36 together along negative sloped interlockably interfitting walls 27*a* and 37*a* to thereby provide an elastic mechanically interlocked joinder of top and bottom tray sections 21 and 31 along their respective peripheral rims 26 and 27.

Figure 2:
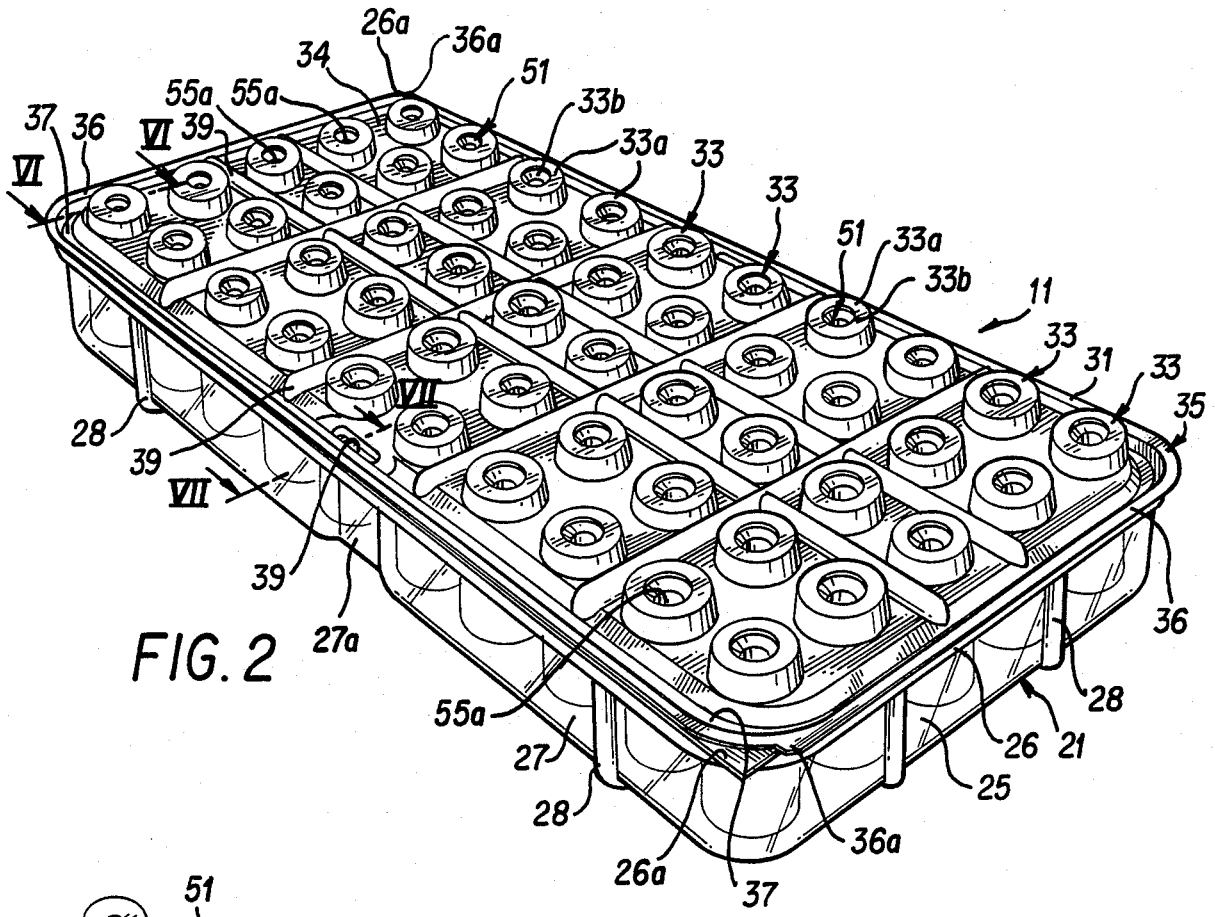
FIG. 2 is a similar isometric view of the embodiment of FIG. 1, with the tray and vial package inverted to present both the pocketed tray bottom, and the associated vials held thereby with their bottom fill ends, facing upward.
Figure 3:
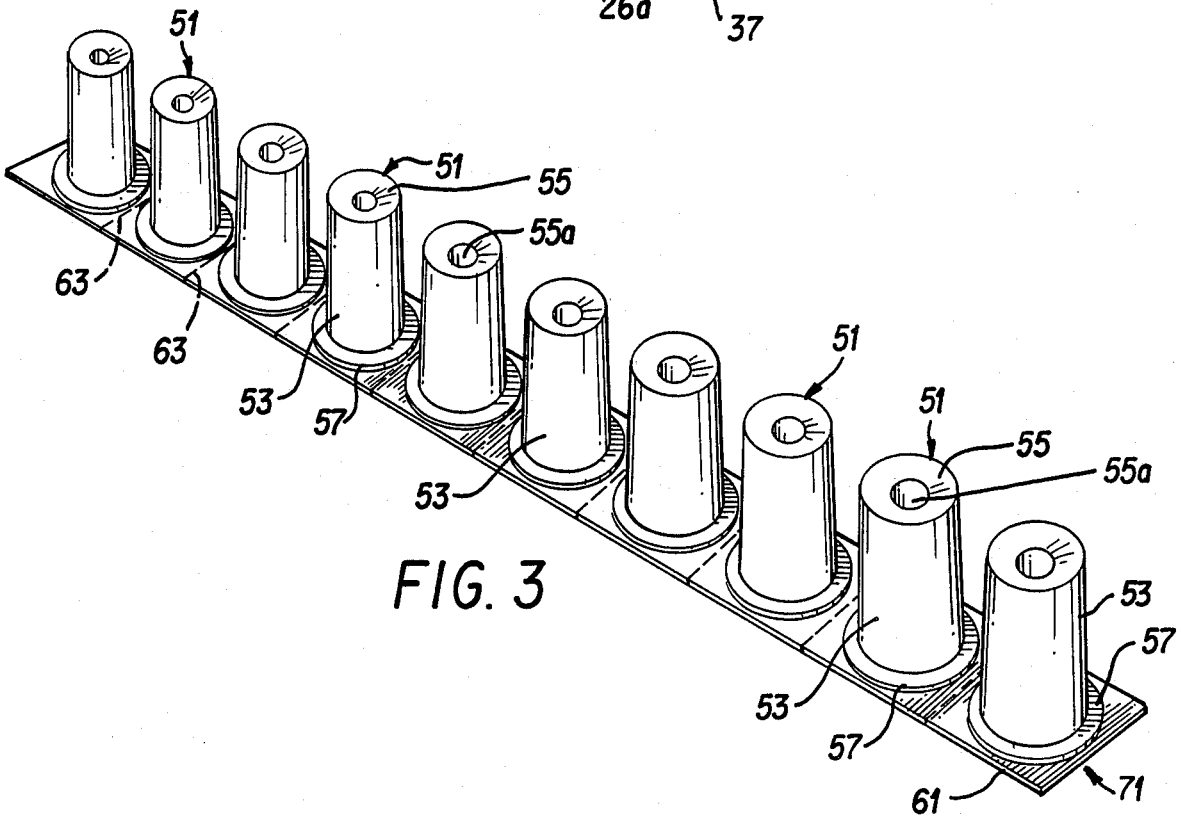
FIG. 3 is an inverted view of one column of vials interconnected and arranged in a manner as employed in the tray/vial package embodiment of FIGS. 1 and 2, and shown with their fill ends facing generally upward and toward the viewer.
Figure 6:
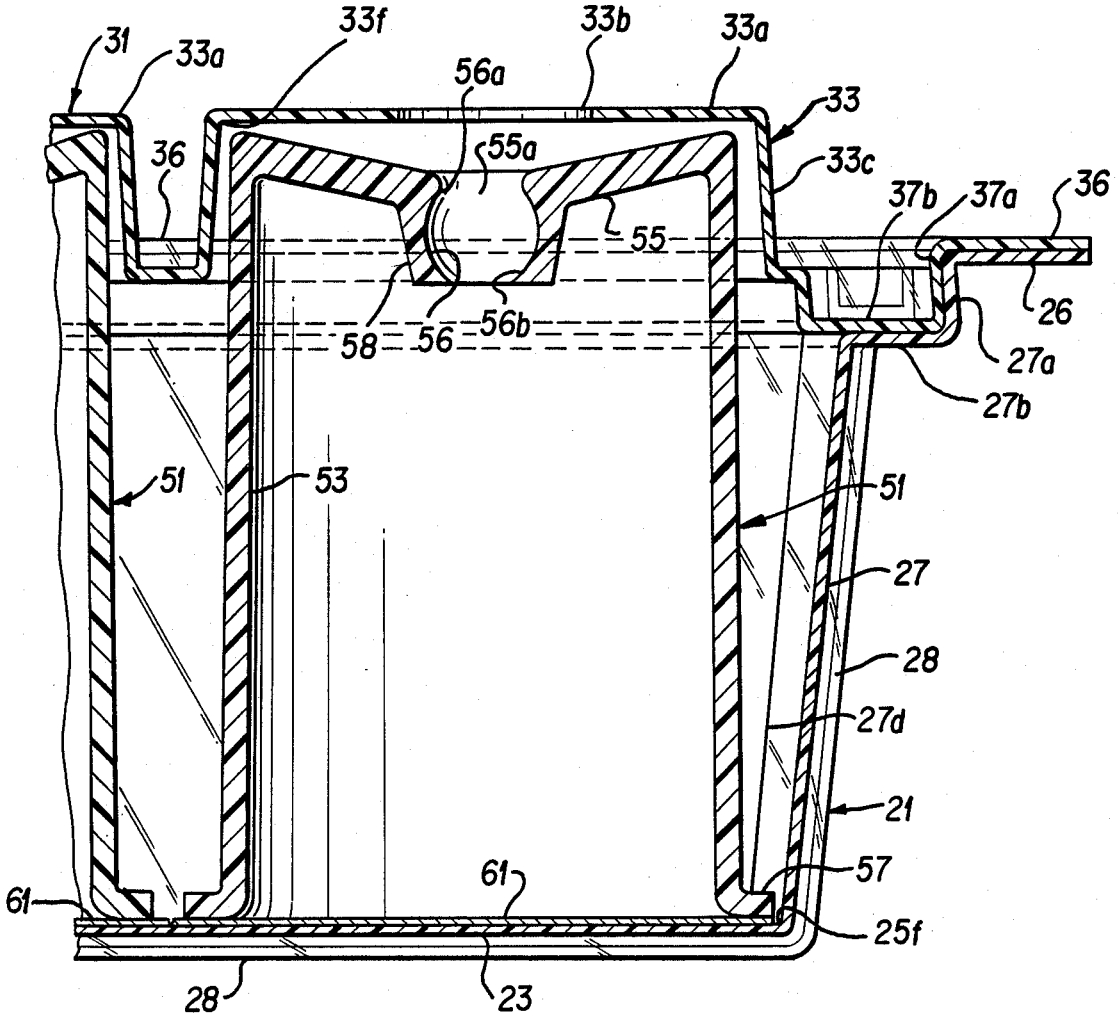
FIG. 6 is a partial section view of the embodiment of FIGS. 1 and 2, taken on the line VI—VI of FIG. 2.
Figure 7:
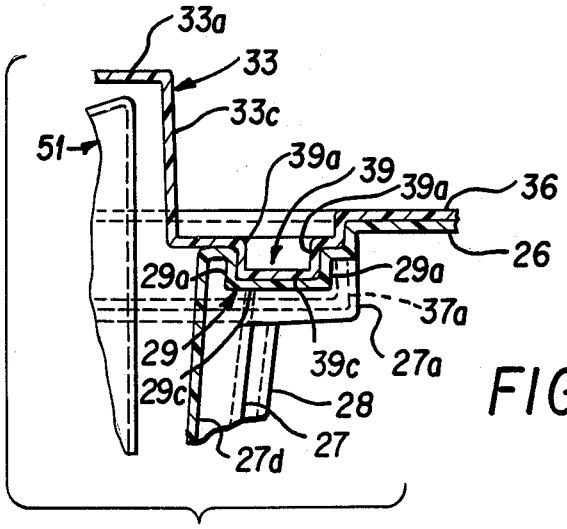
FIG. 7 is a partial section view of the embodiment of FIGS. 1 and 2, taken on the line VII—VII of FIG. 2.

The mechanical interlock formed by negative-sloped elastically interlocking walls is a relatively easily disconnectable interlock, and such rim wall interlock may be, and preferably is, enhanced and augmented by further similar elastic mechanical interlock joints formed between the negative sloped peripheral side walls 29*a* of a raised recess-forming boss 29 formed at the mid-zone of each of the lengthwise rims of peripheral rim 26 on the one hand, and a complementarily shaped boss 39 formed in corresponding locations on each of the two lengthwise rims of peripheral rim 36, as shown in FIGS. 1, 2 and 7. The flat top walls 29*c* and 39*c* of the respective interlocking bosses 29 and 39 mate in adjoining facing relation in the manually elastically snapped together interlocked engagement of the respective securing bosses 29 and 39.

As an aid to manual separation of the tray sections 21 and 31, each of the tray sections is provided with separator tabs 26*a* and 36*a* formed at diagonally opposite corners of respective interlocking peripheral rims 26 and 36 of the tray sections 21 and 31.

Respective recesses 27*a* are desirably formed in side walls 27 of upper tray section 21 to accommodate and enable ease of formation of recess-forming interlock boss 29 in the rim 26.

Each of the tray sections 21 and 31 may suitably have raised ribs formed thereon as an aid in rigidifying the respective tray sections. Suitable such ribs 28 are formed on illustrative tray section 21, and suitable such rigidifying ribs 39 are formed on the bottom tray section 31.

The tray sections may be suitably formed of any suitable material, preferably being molded from any of various suitable plastic material, it being a feature of one aspect of the invention that the top tray section 21 is formed of transparent material to enable external visibility of the label identifying indicia 87 on the tear-perforated label strips 81 attached to the columnar assemblies 71 of vials 51 after filling, so as to enable ease of external visual vial content identification without necessity for opening the tray 11. If desired, the bottom tray section 31 may also be formed of transparent material. However, for simplicity and clarity of illustration the bottom tray section 31 is illustrated as being formed of opaque plastic material.

Referring again to FIGS. 2 and 6, each of the pockets 33 has a ball plug-sealable fill-enabling hole opening 33*b* centrally formed in its respective pocket end wall 33*a*. The fill-enabling hole openings 33*b* are somewhat larger than the fill openings 55*a* of vials 51, which enables and assures effective registry of the vial fill openings 55*a* of each of the vials 51 with the corresponding fill-enabling hole opening 33*b* formed in the retaining end wall 33*a* of respective pocket 33.

Figure 8:
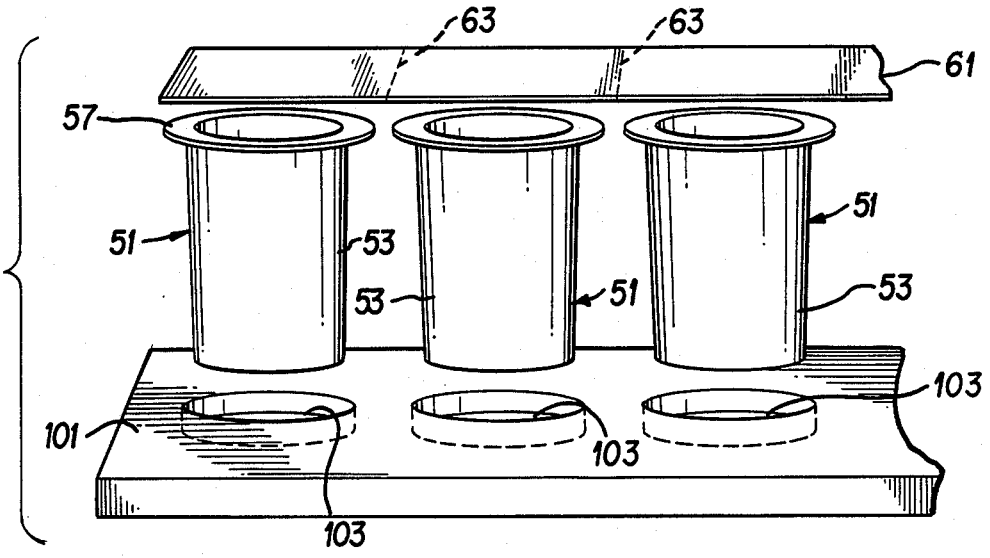
FIG. 8 is a schematic exploded isometric view illustrating the vial elements preparatory to columnar interconnected assembly.
Figure 9:
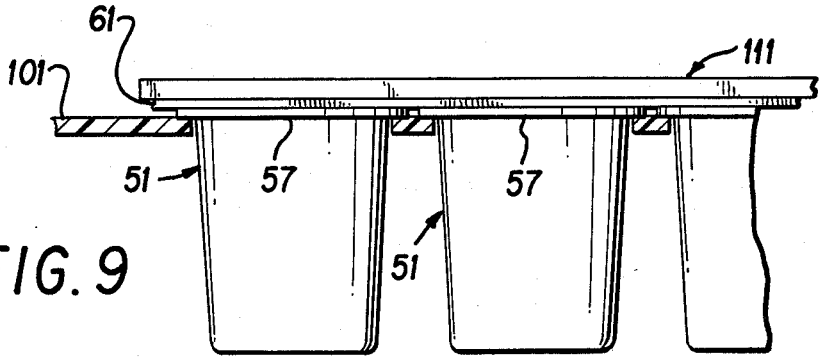

As shown schematically in FIGS. 8 and 9, after molding of the cup-shaped body sections 53, 57 of vials 51, the body sections 53,57 are placed in rim flange-supporting relation in a suitable fixture 101 having ten holes 103 suitably spaced therealong to desirably position the body sections 53, 57 for columnar interconnection, and a tear-perforated foil sealing strip 61 is heat sealed to the top perforated surfaces of flanges 57 about the annular flanged periphery of each of the adjacent vial body sections 53, 57, as by a heat sealing platen suitably pressed down against and along the length of the top of foil strip 61. The heat seal formed thereby is such that the flanged mouth ends of the vials are effectively fluid sealed, while the respective tear separated sealing foil or film section of strip 61 secured to a given vial 51 may be readily peeled off of the peripheral flange 57 at the time when it is desired to administer the vial-filled fluid F to a patient.

Figure 10:
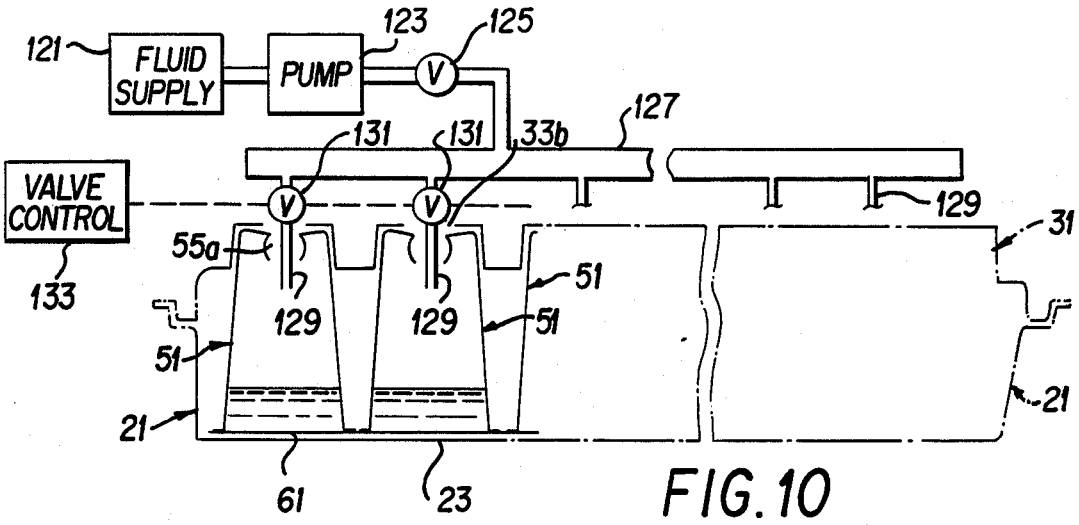
FIGS. 10–13 depict respectively successive vial filling, vial fill opening closure, vial labeling, and tray reclosing of a tray/vial package arrangement utilizing the embodiment of FIGS. 1 and 2.

After assembly of the tray/vial package formed by tray 11 and the multiple columns of separably interconnected vials 51, the vials 51 may be suitably filled in any of several ways including simultaneous multiple vial filling of all or a portion of a column of vials 51, with a filling head formed by a manifold 127 having multiple fill tubes 129 spaced apart a distance corresponding to the spacing of columnar interconnected vials 51, together with suitable fill control valves 131, 131, etc., suitably controlled by a value control 133, the manifold 129 being connected to a pump 123 and fluid reservoir 121 through a main control value 133, as schematically illustrated in FIG. 10. This filling is facilitated and enabled by the grouped and individual positioning and spatially locating of the vials and the maneuverability of the assembly of vials as a unit for ease of filling and other handling, as is afforded particularly by the vial-location pockets 33 with their fill-enabling holes 33*b* formed in their respective end walls 33*a*, thus enabling the insertion of fill tubes 129 directly into fill openings 55*a* while the vials are held and effectively locationally retained within the closed tray 11. The tray 11 may readily be moved vertically or laterally as a unit in handling, including indexed tray movement for presentation of successive groups of vials 51 for filling by fill tubes 129.

Various other modes of filling may be utilized, such as by an operator manually successively individually filling each of the vials 51 within a tray 11, while either manually actuating a control value or employing a fill control value which is automatically successively timed on and off at timed intervals for a desired fill interval with sufficient off period intervals to enable fill tube removal from one vial 51 and insertion into another adjacent vial 51. Or multiple pumps each with a respective fill head may be employed, as with individual controls or a common pump control, to enable precise filling without the various fluid flow adjustments involved in using a common manifold and multiple fill tube arrangement.

Irrespective of the method adopted for filling the vials 51, the tray/vial arrangement 11, 51, 51, etc. provides a unique and highly useful arrangement for vial loading without handling the vials 51 or opening the tray 11.

Figure 11:
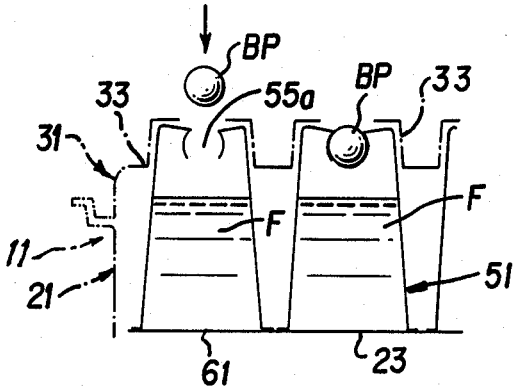

After filling of the vials 51, the fill openings 55*a* are subsequently sealed, as by snap insertion of a ball plug BP into the fill opening 55*a* of each vial 51, as schematially illustrated in FIG. 11, either manually or by manual tool assist or by machine, or otherwise as may be desired.

Figure 4:
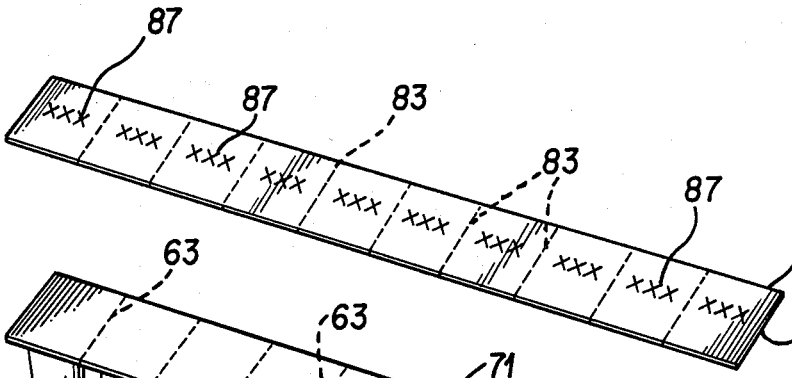
FIG. 4 illustrates a tear-perforated labeling or identifier strip which may be secured to the upper face of the vials according to one embodiment and mode of practice of the invention.
Figure 5:
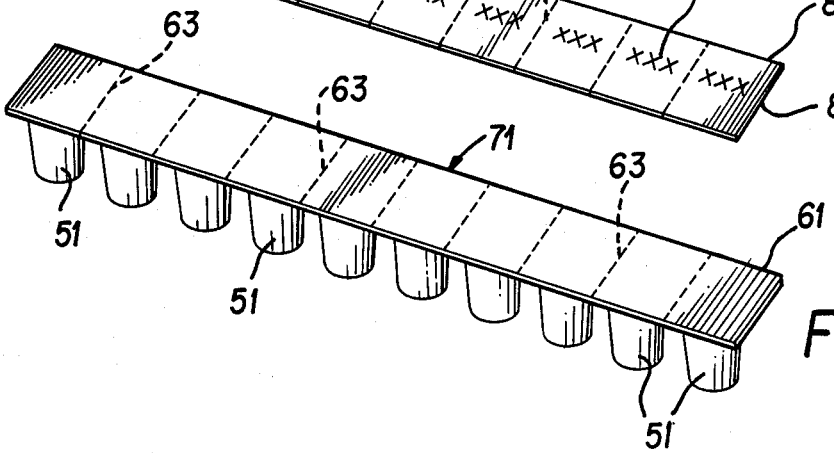
FIG. 5 is a view of the column of interconnected vials of FIG. 3, shown with the vials having the label-receiving mouth ends facing generally upward and toward the viewer.
Figure 12:
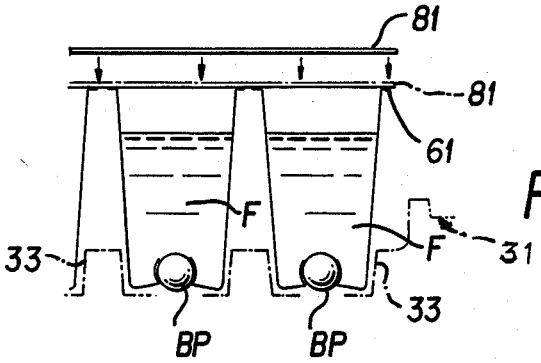
Figure 13:
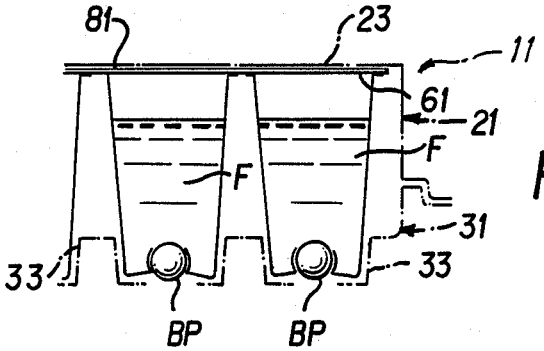

After sealing of the vial fill openings 55*a* with ball plugs BP, the entire tray/vial assembly 11, 51, 51 etc is turned over to its normal upright position with pocketed tray section 31 at the bottom and supporting vials 51 in pockets 33. The top tray section 21 is thereupon separated and removed from the bottom tray section 31, which is facilitated by separator tabs 26*a*, 36*a* on the respective tray sections 21 and 31; and, as schematically illustrated in FIG. 12, a tear-perforated label strip 81 having appropriate indicia printed thereon for each vial is attached to the upper or outer face of each of the tear-perforated foil sealing strips for the multiple columns of sealing strip-interconnected vials 51. This may preferably be effected by simply press securing the appropriately printed label strips 81 onto the face of the sealing strips to adhere such thereto through the action of the pressure sensitive adhesive coated face 89 (see FIG. 4) of such label strips 81, after which the top tray section 21 is replaced onto, and connected in interlocking relation with, the bottom tray section 31 as shown in FIG. 13, thereby completing the operation and providing a readily transportable tray/vial package which may be carried to a patient location or other desired location, whereupon the top tray section 21 may again be removed, and a selected one or more of the vials 51 may be manually separated from the adjoining other vials 51 of one or more of the columns 71 of tear-perforated sealing strip-interconnected vials 51, for serving of the fill contents F of the removed vial 11 to a patient, after also peeling off the sealing foil from the mouth end of the vial 51. The tray top section 21 may then again be replaced and the tray/vial package assembly may be transported to another location for removal and serving of another vial 51 to a patient or otherwise as may be desired.

While the invention has been illustrated and described with respect to an illustrative and preferred embodiment, and mode of practice, it will be apparent that various modifications and improvements may be made without departing from the scope and spirit of the invention. Accordingly, the invention is not to be limited by the particular illustrative embodiment and mode of practice, but only by the scope of the appended claims.

I claim:

1. The method of forming a hospital usable package of a plurality of fillable fluid-holding vials, each of which has a fill opening at one end thereof and an opposite end having a peripheral flange formed thereon, comprising:

removably attaching a common sealing sheet of effectively fluid-sealing material in sealing relation with said peripheral flange of each of a plurality of said vials arranged with their respective said flanges in adjacent substantially linearly aligned side-by-side relation, to thereby form a linear row of said vials laterally interconnected at their said opposite ends by said common sealing sheet material, and having their said one end extending freely from said sheet, inserting said row of sheet-interconnected vials into a tray having first and second interfacing and separable interconnectable vial containment sections of which said first section is a locating-pocket section having a plurality of linearly spaced and aligned vial-locating-pockets formed therein and generally corresponding in effective vial-lateral-locating and positioning size at their outer ends relative to the peripheral size of said fillable one end of said vials, the spacing of said fillable free end of said vials being generally peripherally locationally complementary at their respective said fillable free ends with the outer ends of said pockets, and each of which pockets has an opening in its outer end, and disposing said row of sheet-interconnected vials, each with its said free one end extending into side-by-side spatial locating relation within said pockets and with said central fill opening in registry with the corresponding said openings in said pockets of said one tray section and with said sheet-sealed flanged ends extending into and retained by said second section, to thereby form a package of vials which enables ease of vial filling and of vial closure after vial filling without handling or unwrapping of said vials.

2. The method according to claim 1, further comprising:

forming perforated tear separation lines in said sheet at the zone of adjacency between respective said side-by-side vials.

3. The method according to claim 1, further comprising:

forming a plurality of said rows of sheet-interconnected vials and disposing each of said rows of vials within said tray in laterally side-by-side relation and with their respective vials being disposed in effective lateral displacement location-retaining relation within respective correspondingly linearly aligned and spaced said pockets in said first locating-pocket section of said tray.

4. The method according to claim 3, further comprising:

disposing the closed said tray with said vials locationally held therein and with said first locating-pocket section facing upward, filling said vials in each of said rows of sheet-connected vials by passing a selected fluid through each of said openings in said pockets and through the corresponding said fill opening in the respective said vial locationally therein, and closing each said fill openings after filling of the respective said vial.

5. The method according to claim 4, further comprising:

subsequently disposing said first locating-pocket section as the lower section thereof, opening said tray to expose said common-sealing sheet material while said rows of vials are held in said first locating-pocket section thereof, and applying label means to said sealing sheet material.

6. The method according to claim 5, further comprising:

reclosing said tray after applying said label means.

7. The method according to claim 5, wherein said applying of said label means is effected by applying a pressure-sensitive adhesive label sheet material to said sealing sheet and which said adhesive sheet has indicia thereon identifying the selected fill fluid in each respective filled vial.

8. The method according to claim 7, wherein said pressure-sensitive adhesive sheet has spaced lines of perforations therein at spaced intervals corresponding to the spacing of said vials in each of said rows, and substantially registering said lines of perforations with the zones between each of said vials, whereby said vials may be easily separated, and said applying of label means being effected by applying said label means in strips of said pressure-sensitive label sheet material generally corresponding to the size of said common sealing sheet for each of said row of vials and with said lines of perforations in each of said strips being in effective general registry with said lines of perforations in said sealing sheets sealing and interconnecting each of said vials in its respective said row.

9. The method according to claim 8, further comprising:

transporting said package to a desired end use location after filling and closing of said vials, opening said tray sections, and removing a selected one of said vials, and removing said sealing sheet for said selected one vial while disposing said one vial with said sealing sheet facing upward to thereby enable dispensing of the fill fluid from the thus opened end of said selected vial.

10. The method according to claim 4, further comprising:

effecting said filling by simultaneously filling a plurality of said vials, and successively repeating said concurrent plural vial filling for additional groups of vials.

11. The method according to claim 4, further comprising:

effecting said filling by simultaneously filling all of said vials forming one of said rows of vials with a selected fluid, and successively and similarly filling each of the remaining ones of said rows of vials with a given selected fluid.

12. The method according to claim 11, further comprising:

turning said tray over to dispose said first pocket-forming section below said second section, opening said sections to expose said common sealing sheet material while holding said rows of vials in said pockets of said first pocket-forming section of said tray, and applying labelling means to the exterior facing surface of said sealing sheet material on each of said rows of vials.

13. The method according to claim 12, further comprising:

reclosing said tray after applying said labelling means.

14. The method according to claim 13, further comprising:

forming spaced apart perforated tear separation lines in said sheet at the zone of adjacency between respective said side-by-side vials in each of said rows, said applying of said labeling means being effected by adhering a separate label strip onto said sealing sheet material for each of said rows of vials, and effectively generally registering spaced apart tear separation lines in each of said label strips with said tear separation lines in said strip of sealing sheet material interconnecting each of said rows of vials.

15. The method according to claim 14, wherein said separate label strips are applied as perforated label strips having a pressure-sensitive adhesive surface and which is pressure-applied to the exposed outwardly facing surface of said sealing sheet material interconnecting said vials forming each of said rows of vials.

16. The method according to claim 1, further comprising:

employing an effectively transparent said other tray section to enable external visual identification of indicia on said labeling means while said tray sections are closed together.

17. A package for enabling ease of health care fluid-filling, closing, labelling and handling of fillable vials by a hospital or other health care facility, comprising:

first and second interfacing separably interfitting sections forming an openable tray, one of said sections having a plurality of vial-locating pockets formed in side-by-side relation therein, each said pockets having a vial-retaining end wall and a fill-enabling, closing-enabling, opening formed in said bottom wall, and a plurality of vials, each of which is closed at one end and has a closable fill opening at its other fill end, said vials being disposed within said tray, with said other fill end of each of said vials being disposed in seated relation within a respective one of said pockets and with its said fill opening disposed in effective fill-enabling registry with the corresponding said fill-enabling opening in its respective said pocket.

18. A package according to claim 17, further comprising:

a resiliently interlocking rim formed on said sections and interconnecting said sections in selectively separable relation.

19. A package according to claim 18, further comprising:

each of said vials having a closure seal removably secured across a dispensing opening formed at said one closed end thereof.

20. A package according to claim 17, said closure seal for each of said vials comprising a sheet of sealing material removably adhered to the respective said vial.

21. A package according to claim 20, said vials being disposed in at least one linear row of side-by-side vials, and said sheet of sealing material for each of said vials in said one row being a single-sealing sheet common to and removably secured to all of the vials in said row, and which single-sealing sheet interconnects all of said vials in said one row.

22. A package according to claim 21, said sealing sheet having perforated tear lines formed therein at the zones of adjacency of said vials of said one row.

23. A package according to claim 22 further comprising:

a pressure-sensitive adhesive label sheet for securing to said sealing sheet of said one row of vials after filling thereof, said label sheet generally corresponding in size to said sealing sheet for said one row, and having perforated tear lines formed therein and which are effective substantially registrable with said perforated tear lines formed in said sealing sheet when said label sheet is adhered to said sealing sheet.

24. A package according to claim 20, said vials being disposed within said tray as a plurality of side-by-side linear rows of vials, said sheet of sealing material for each of said vials in each of said rows being a single sealing sheet common to and removably secured to all of the vials in said row, each of which said single sealing sheets interconnects all of said vials in its respective row.

25. A package according to claim 24, each of said single-sealing sheets having perforated tear lines formed therein at the zones of adjacency of said side-by-side vials forming each of said rows of interconnected vials.

26. A package according to claim 25, further comprising a plurality of pressure-sensitive adhesive label sheets for securing to the respective said sealing sheet for each of said rows of vials, said label sheets generally corresponding in size to said sealing sheets and having perforated tear lines formed therein and which are effectively substantially registrable with said perforated tear lines formed in each of said single-sealing sheets interconnecting said vials of each of said rows.

27. A package according to claim 26, each of said vials having an inwardly extending tube which has an annular tubular wall forming a tubular opening defining said fill opening for the respective said vial, said package further comprising individual sealing plugs insertable in sealing relation within each of said tubular openings.

28. A package according to claim 27, said tubular walls being elastically resilient and being formed with a longitudinally concave plug-retaining internal surface shape facing and forming said fill opening, and said sealing plugs being ball plugs and being elastically seatable within said concave plug-retaining tubular surface forming said fill opening.

29. A package according to claim 17, further comprising:

said other of said tray sections being formed of transparent material to enable visual identification of identifying indicia on said labelling means.

* * * * *